US006220315B1

(12) United States Patent
Purschke

(10) Patent No.: US 6,220,315 B1
(45) Date of Patent: Apr. 24, 2001

(54) METHOD FOR MACHINING WORKPIECES

(76) Inventor: Guenter Purschke, Oleanderstrasse 9, D-75031 Eppingen (DE)

( * ) Notice: Subject to any disclaimer, the term of this patent is extended or adjusted under 35 U.S.C. 154(b) by 0 days.

(21) Appl. No.: 09/403,833

(22) PCT Filed: Apr. 24, 1998

(86) PCT No.: PCT/DE98/01151

§ 371 Date: Oct. 27, 1999

§ 102(e) Date: Oct. 27, 1999

(87) PCT Pub. No.: WO98/48984

PCT Pub. Date: Nov. 5, 1998

(30) Foreign Application Priority Data

Apr. 30, 1997 (DE) ..... 197 18 306

(51) Int. Cl.[7] ..... B27M 1/08

(52) U.S. Cl. ..... 144/3.1; 144/3.1; 144/90.1; 144/242.1; 144/245.1; 144/245.2; 144/250.21; 144/250.23; 144/91; 144/114.1; 144/128

(58) Field of Search ..... 144/3.1, 85, 86, 144/90.1, 91, 242.1, 245.1, 250.23, 245.2, 154, 250.21, 363, 114.1, 117.1, 128

(56) References Cited

U.S. PATENT DOCUMENTS 1,801,244 * 4/1931 Blood ..... 144/90.1
2,581,947 * 1/1952 Foir ..... 144/91
3,826,164 * 7/1974 Campbell ..... 144/242.1
4,878,524 * 11/1989 Rosenthal et al. ..... 144/3.1
4,881,583 * 11/1989 Zehender ..... 144/3.1
4,941,521 * 7/1990 Redekup et al. ..... 144/3.1
5,617,910 * 4/1997 Hill ..... 144/91

FOREIGN PATENT DOCUMENTS 38 30 976 6/1990 (DE) .
43 10 399 10/1994 (DE) .
261 568 3/1988 (EP) .
2 125 728 3/1984 (GB) .

* cited by examiner

*Primary Examiner*—W. Donald Bray
(74) *Attorney, Agent, or Firm*—Browdy and Neimark

(57) ABSTRACT

A method for processing of workpieces, which are supplied to a processing station, in which the workpieces are processed on one side, are moved out of the processing station, and are turned and again supplied to the processing station for processing the second side. In particular, a workpiece or workpiece package is individually supplied to the processing station, is processed there and individually moved on following the processing of both sides. The first side of one workpiece, whose second side has not yet been processed, and the second side of another workpiece whose first side had already been processed in the previous processing operation, are processed in one processing operation in the processing station, so that during each processing operation a workpiece processed on both sides is created together with a workpiece processed only on one side.

5 Claims, 6 Drawing Sheets

METHOD FOR MACHINING WORKPIECES

Figure 1:
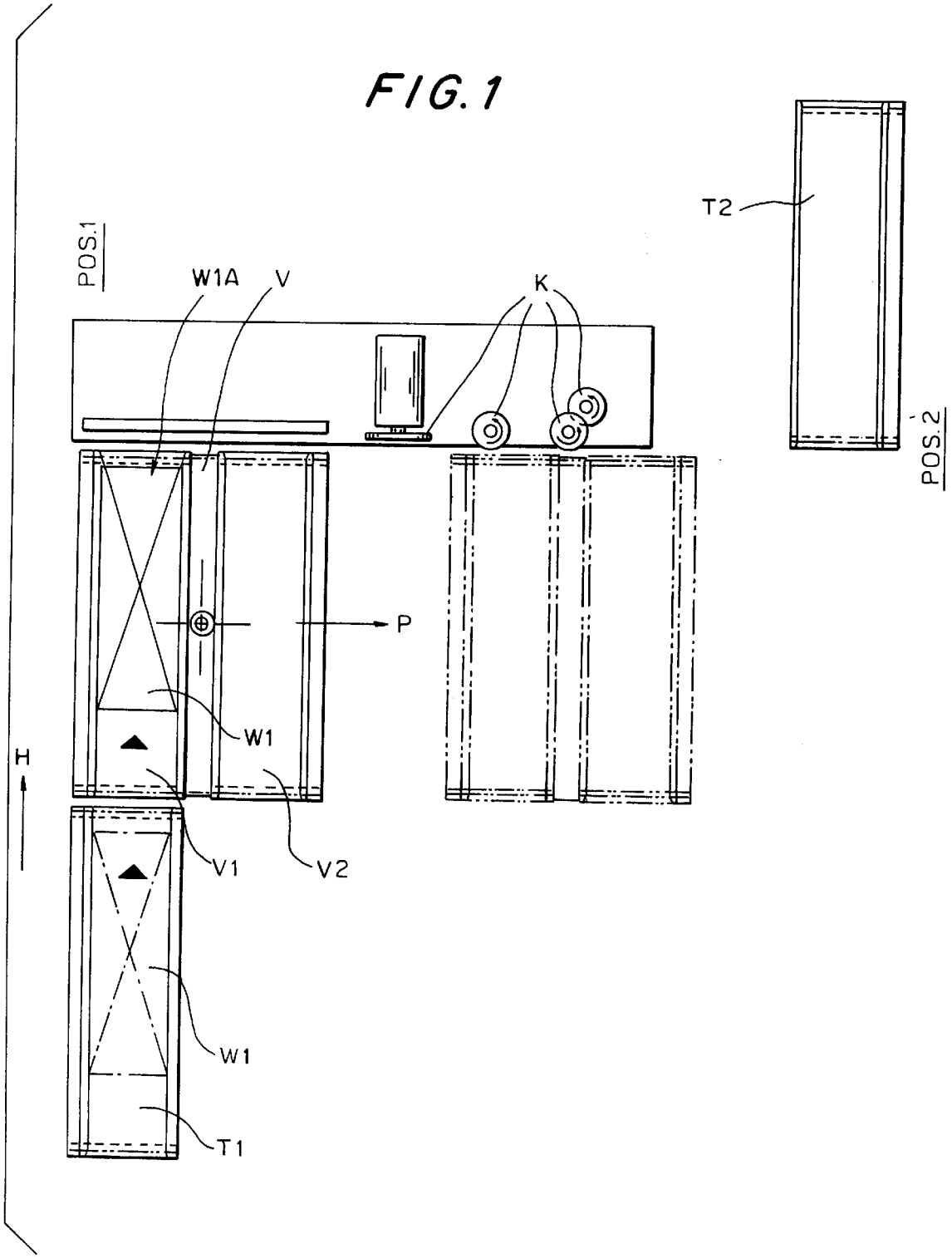

This application is the national phase of international application PCT/DE98/01151 filed Apr. 24, 1998 which designated the U.S.

BACKGROUND OF THE INVENTION

1. Technical Field of the Invention

The invention relates to a method for processing workpieces which are supplied to a processing area, are processed there on one side, are moved out of the processing area, are turned and are again supplied to the processing area for processing the second side.

Processing methods within production installations—for example of the wood-processing industry in the sector of "dovetail joint installations"—are sufficiently known. However, all of these have the disadvantage that, when using only a single processing machine—for example dovetail joint machines—, which is supplied by means of a forward feed device for producing a workpiece or workpiece package which is finished on both ends, an unproductive, time-consuming return of the empty forward feed device for being again loaded with work pieces is always required.

2. Prior Art

A typical example of such a method is known from the species-defining Laid-Open Application 43,10,399. The subject of this laid-open application is a combination of forward feed movements with turning movements, wherein the turning movement is required for moving the two spaced-apart or oppositely-located workpieces, which are respectively to be processed, to the processing station. A work table is used for this which, with workpieces placed on it, is moved past end-processing tools 3 and 4, and in the process performs a pendulum movement between a starting position and an end position.

It is of particular disadvantage, that the return of the work table here also takes place empty, i.e. without a workpiece on it, because a very elaborate turning device (FIG. 2 in 43,10,399), which can be displaced on several work levels, is required outside of the work table 1, which also contains devices, with whose aid the return trip of the workpiece which was processed on one side, to the starting position of the work table 1 takes place. Thus, while the worktable returns idle, and therefore without doing useful work, the elaborate turning of the workpiece, which was processed on one side, is performed parallel with this.

BRIEF SUMMARY OF THE INVENTION

It is the object of the invention to design such known processing methods simpler and more efficiently.

In accordance with the invention, this object is attained by supplying a first workpiece that has already been processed on the first side together with a second workpiece that has not previously been processed on the first side or the second side to the processing station; processing the second side of the first workpiece and the first side of the second workpiece in one processing operation in the processing station; and individually moving the first workpiece on following the one processing operation, whereby during each processing operation a workpiece processed on both sides is created together with a workpiece processed only on one side.

The unproductive return movement of the forward feed device (corresponding to the work table 1) is avoided in that, in accordance with a preferred embodiment of the object attained by the invention, the forward feed device itself is turned between successive work cycles and therefore is also used for the return transport of a workpiece with a front face processed on one end. Here, the forward feed device V performs a double function in that it performs the processing forward feed, turning of the workpiece and return of the workpieces processed on one end, functions, which must be performed by separate devices in connection with the subject of the Laid-open application 43,10,399.

Thus, by means of the method in accordance with the invention, the return trip of the forward feed device (corresponding to the work table 1 of Laid-open application 43,10,399) in particular is also actually used.

In accordance with a further advantageous embodiment it is also not important whether individual workpieces or a workpiece package formed by identical workpieces is employed, but instead, that during each processing operation (i.e. each forward feed of two workpieces or workpiece packages to the tools K), a respective workpiece or workpiece package, whose first side is being processed, is located on the forward feed device V, and a workpiece or workpiece package, whose second side is being processed or, in simpler terms a pair of workpieces or workpiece packages with altogether an uneven number of processed sides, lies on the forward feed device before or after each processing operation. In the exemplary embodiment of the invention represented (FIG. 5), there are three such processed sides. In contrast thereto, with comparatively the same outfitting in pairs, there is always a pair of workpieces with an even number of processed sides, i.e. a total of two or four processed sides, located on the worktable of the subject of Laid-Open Application 43,10,399.

With the embodiment of the method in accordance with the invention, at least two workpieces and/or workpiece packages, which are separated from each other, are always located in the forward feed device, or respectively its transport devices. In the process, one of them is processed for the first time, i.e. afterwards it has been processed only on one side, but another workpiece or workpiece package is already finished on both sides after each processing operation.

Thus, the advantage over the known method lies in that—except for the first processing operation when the production installation is started up—during the entire running time of these installations, at least one workpiece or workpiece package which is finished on both sides, is produced in every further processing operation. An unproductive return of empty forward feed, or respectively transport devices, is avoided here, therefore a workpiece of workpiece package which is finished on both sides, is created during each processing operation.

This means a considerable shortening of the production times of the workpieces/workpiece packages, and therefore a meaningful productivity increase of the entire production installation.

BRIEF DESCRIPTION OF THE SEVERAL VIEW OF THE DRAWINGS

Figure 2:
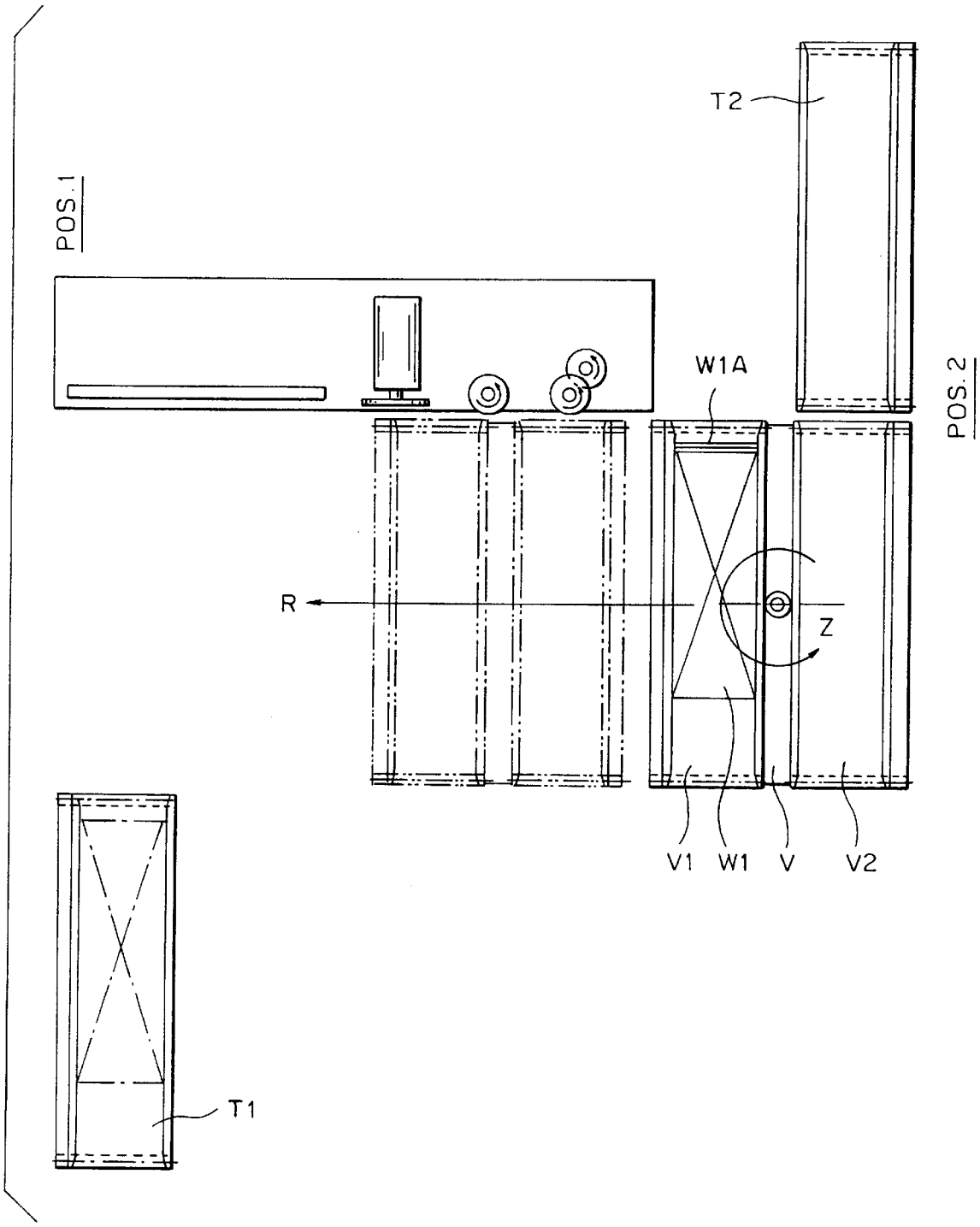
Figure 3:
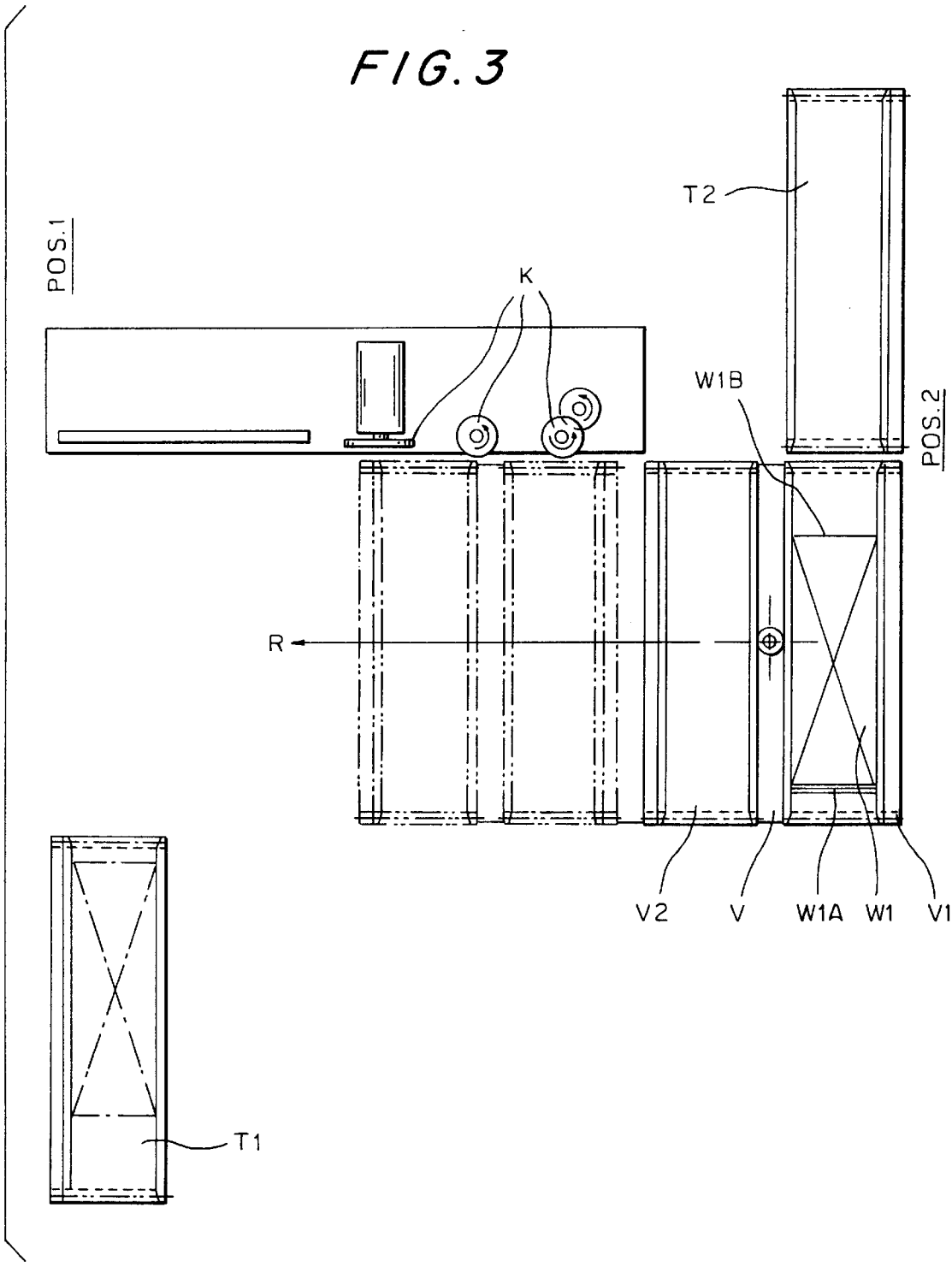
Figure 4:
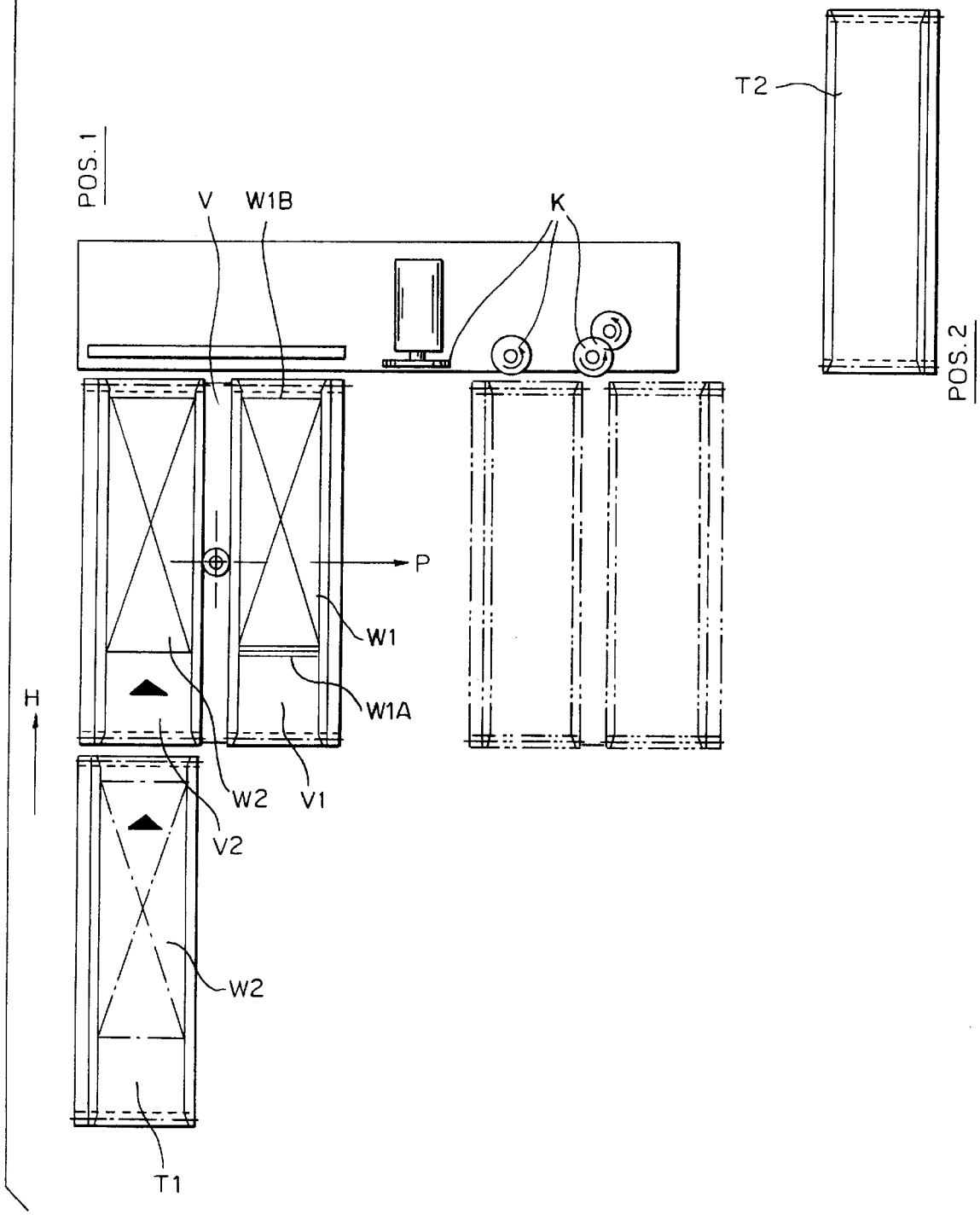
Figure 5:
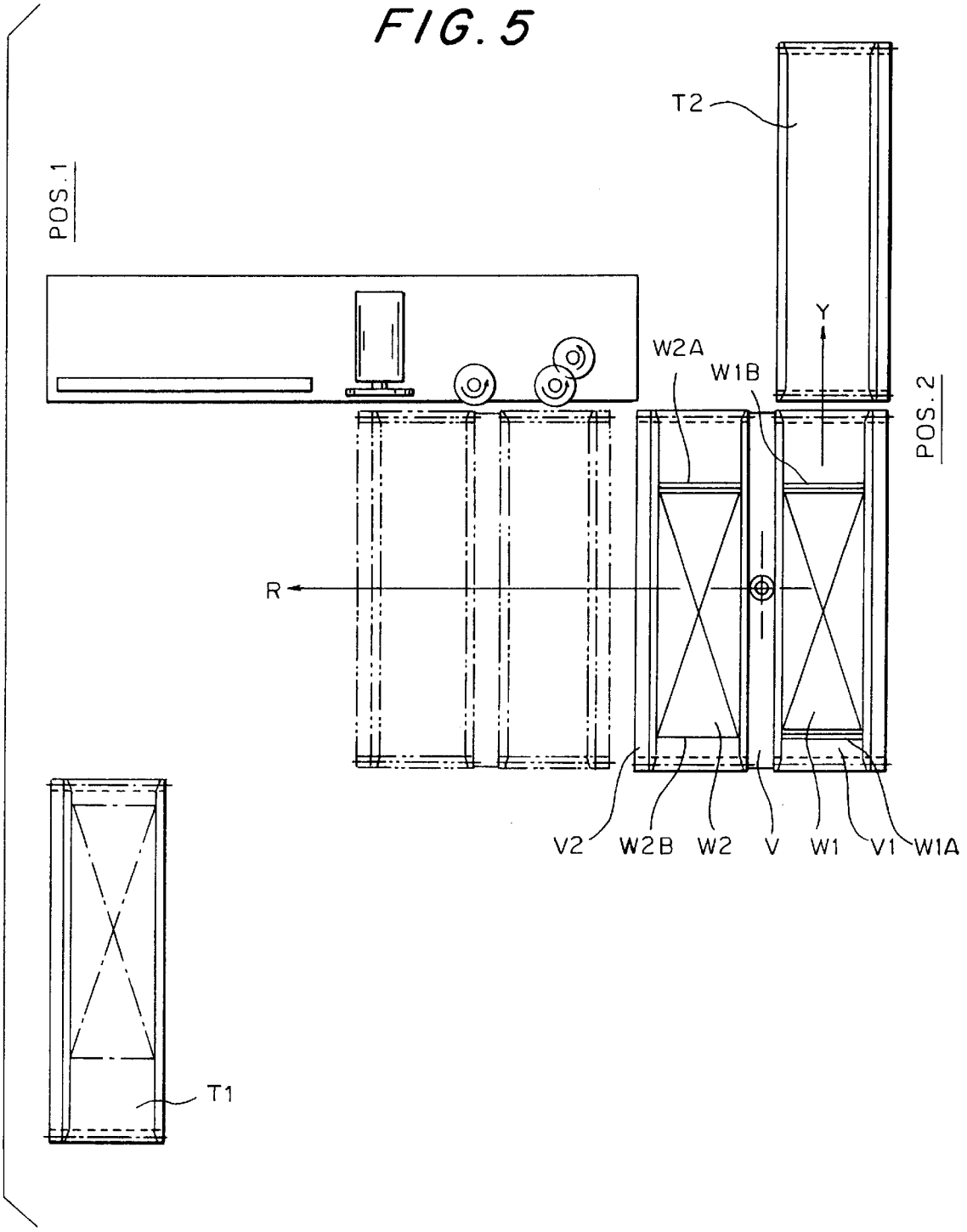
Figure 6:
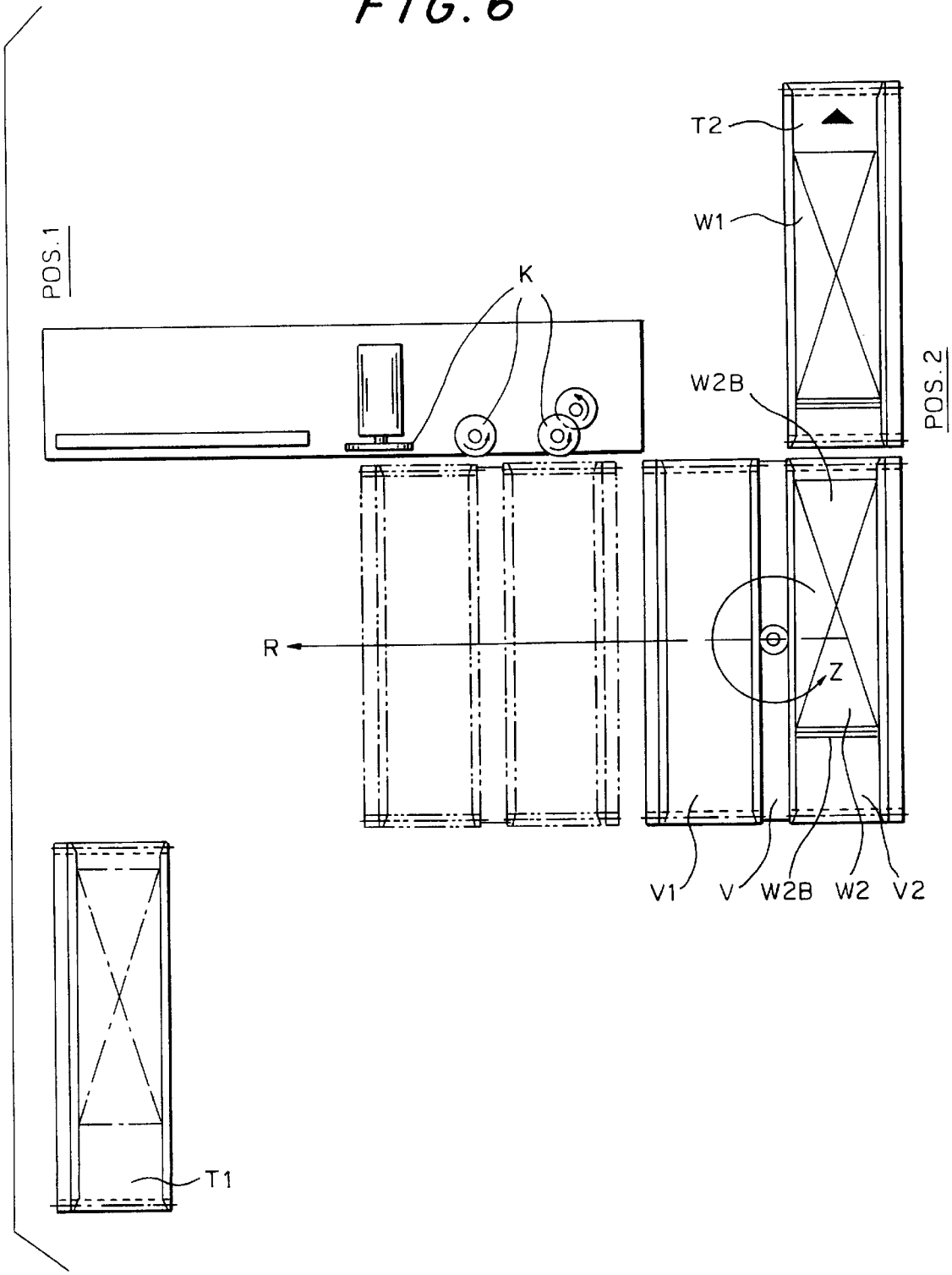

A preferred exemplary embodiment of the method in accordance with the invention will now be explained by means of the drawings and a function description; shown are in:

FIG. 1, a plan view of the device intended for executing the method of the invention in the course of delivering a first workpiece, FIG. 2, a plan view in accordance with FIG. 1 in the course of performing a processing operation on the first side of the first workpiece, FIG. 3, a plan view in accordance with FIG. 1 after turning the first workpiece by 180°, FIG. 4, a plan view in accordance with FIG. 1 after the return movement of the forward feed device and in the course of supplying the second workpiece, FIG. 5, a plan view in accordance with FIG. 1 after the performance of the next processing operation on the second side of the first workpiece and the first side of the second workpiece, and FIG. 6, a plan view in accordance with FIG. 1 after turning the second workpiece by 180°.

DETAILED DESCRIPTION OF THE INVENTION

The first workpiece package W1 consisting of any arbitrary number of workpieces—hereinafter called "workpiece"—rests on a conveyor belt T1. From there, it is passed in the direction H to a conveyor belt V1 of the forward feed device V, which is in a standby position in position 1.

The forward feed device V now moves in the direction P and feeds the first workpiece W1 to be processed to the processing tools K (FIG. 1).

The forward feed device V stops in the position 2 at the end of the processing operation; the first side W1A of the first workpiece W1 has now been processed. The forward feed device V is now turned by 180° around its vertical axis (Z) (FIG. 2).

Because of the turning of the first workpiece W1 resulting from the turning of the forward feed device V, the unprocessed second workpiece side W1B, as shown in the broken line position of FIG. 3, now lies in the effective range of the tools K and therefore can be processed in the next processing operation. The forward feed device V moves back in the direction R and stops in position 1 (FIG. 4).

Now the second workpiece W2 is supplied to the transport device V2 by the transport device T1. The forward feed device V now again moves in the direction P and conducts the workpieces W1 and W2 together to the processing tools K (FIG. 4).

At the end of the processing operation in the processing station, the forward feed device V stops in the position 2. Both sides W1A and W1B of the first workpiece W1, as well as the first side W2A of the second workpiece W2 have now been processed.

The first workpiece W1 is now finished and is conducted in the direction Y to the transport device T2. Because of this, the transport device V1 of the forward feed device V is empty (FIG. 5).

The forward feed device V now again is turned around its vertical axis Z by an angle of 180°.

Because of the resultant turning of the second workpiece W2, its unprocessed second workpiece side W2B now lies in the effective range of the tools K and therefore can be processed in the next processing operation.

The forward feed device V again moves in the direction R back to the position 1 and the above described processes, represented in FIGS. 3 and 4, are now repeated again (FIG. 6).

What is claimed is:

1. A method for processing workpieces each having a first side and a second side opposite to the first side, which are supplied to a processing area in a processing station, are processed there on one side, are moved out of the processing area, are turned and are again supplied to the processing station for processing the second side, said method comprising:

supplying a first workpiece that has already been processed on the first side together with a second workpiece that has not previously been processed on the first side or the second side to the processing station;

processing the second side of the first workpiece and the first side of the second workpiece in one processing operation in the processing station; and individually moving the first workpiece on following the one processing operation, whereby during each processing operation a workpiece processed on both sides is created together with a workpiece processed only on one side.

2. The method in accordance with claim 1, wherein:

said step of supplying comprises rotating the first workpiece about a vertical axis at a removal station and moving the first workpiece in a return direction and supplying the second workpiece from a supply station by moving the second workpiece in a forward direction and turning the first workpiece around a vertical axis; and said step of individually moving comprises moving the first workpiece in the forward direction to the removal station.

3. The method in accordance with claim 2, wherein the vertical axis is centered in relation to the forward direction.

4. The method in accordance with claim 1, wherein each of the workpieces is a wood plate, the first and second sides of each wood plate are ends of the wood plate, and the processing operation consists of a shaping processing of the ends of each wood plate.

5. The method in accordance with claim 1, wherein said step of supplying comprises conveying the first and second workpieces to the processing station by a forward feed device.

* * * * *